US006299084B1

(12) United States Patent
Virving

(10) Patent No.: US 6,299,084 B1
(45) Date of Patent: Oct. 9, 2001

(54) FEEDING DEVICE FOR FIBROUS MATERIAL

(75) Inventor: Nils Virving, Stockholm (SE)

(73) Assignee: Valmet Fibertech Aktiebolag (SE)

( * ) Notice: Subject to any disclaimer, the term of this patent is extended or adjusted under 35 U.S.C. 154(b) by 0 days.

(21) Appl. No.: 09/341,815

(22) PCT Filed: Feb. 3, 1998

(86) PCT No.: PCT/SE98/00184

§ 371 Date: Jul. 19, 1999

§ 102(e) Date: Jul. 19, 1999

(87) PCT Pub. No.: WO98/36837

PCT Pub. Date: Aug. 27, 1998

(30) Foreign Application Priority Data

Feb. 25, 1997 (SE) ..... 9700677

(51) Int. Cl.[7] ..... B02C 23/02
(52) U.S. Cl. ..... 241/247; 241/246
(58) Field of Search ..... 241/246, 247, 241/261.2, 261.3, 244

(56) References Cited

U.S. PATENT DOCUMENTS 3,902,673 * 9/1975 Berggren ..... 241/246
3,957,214 * 5/1976 Berggren ..... 241/246
4,220,290 * 9/1980 Johansson ..... 241/247
5,040,736 * 8/1991 Obitz ..... 241/247

FOREIGN PATENT DOCUMENTS 1 090 937 10/1960 (DE) .

* cited by examiner

*Primary Examiner*—Rodney A. Butler
(74) *Attorney, Agent, or Firm*—Lerner, David, Littenberg, Krumholz & Mentlik, LLP

(57) ABSTRACT

Feeding elements are disclosed for use in connection with refiners for lignocellulosic fibrous material including a stationary refiner, a rotary refiner mounted for rotation in juxtaposition with the stationary refiner thereby forming a refining gap therebetween, a feeder for feeding the lignocellulosic fibrous material centrally to a central feed zone within the refining gap and a refining zone extending radially outward from the central feed zone, the feeding element including a disk for mounting on the rotatable refiner at a central location in the central feed zone, the disk including at least one radially projecting strip extending from the central portion of the disk towards the outer circumference of the disk and including a body and a projecting portion extending laterally from the body at a location displaced from the upper surface of the disk for a major portion of the radially projecting strip.

5 Claims, 2 Drawing Sheets

FEEDING DEVICE FOR FIBROUS MATERIAL

FIELD OF THE INVENTION

The present invention relates to a device for treating lignocellulosic fibrous material in a refiner. with opposed refining means rotating relative to each other, which are provided with refining elements, which between themselves form a refining gap with a refining zone for working the material. More particularly, the present invention relates to such a device in which the lignocellulosic material is supplied through a central opening in the stationary refining element to a feed zone located radially inside the refining zone, and most particularly, to a feeding device for the material.

The device according to the present invention can be used during the manufacture of various types of mechanical pulps, such as refiner mechanical pulp (RMP), thermomechanical pulp (TMP), chemi-mechanical pulp (CMP) and chemi-thermomechanical pulp (CTMP). The starting material can be wood chips or more or less worked pulp.

BACKGROUND OF THE INVENTION

In connection with the above-referenced type of refiners, the inner portion of the feed zone the effect of centrifugal force on the supplied material is low. For this reason, the material supplied through the opening in the stationary refining element is generally not fed out sufficiently rapidly through the feed zone to the refining zone, which is located radially outward from the feed zone. As a result, the material can clog in the feed zone, which results in friction losses and non-uniform feeding, which in turn leads to deterioration in the pulp quality. For overcoming these problems, mechanical feeding devices of different types have been arranged in the feed zone, for example wings, blades, strips or the like. These devices, however, have not worked satisfactorily, particularly not when they have been designed so as to render the rotating refining means to reverse. It is thus often desired to be able to reverse the rotation of the refining means during pulp manufacture, since this can increase the life of the refining elements.

SUMMARY OF THE INVENTION

In accordance with the present invention, these and other objects have been realized by the invention of a feeding element for use in connection with a refiner for lignocellulosic fibrous material including a stationary refining member, a rotary refining member mounted for rotation in juxtaposition with the stationary refining member thereby forming a refining gap therebetween, a feeder for feeding the lignocellulosic fibrous material centrally to a central feed zone within the refining gap, and a refining zone extending radially outward from the central feed zone, the feeding element comprising a disk having a central portion, an outer circumference, an upper surface and a lower surface for mounting on the rotary refining member at a central location in the central feed zone, the disk including at least one radially projecting strip extending from ihe central portion of the disk towards the outer circumference of the disk, the at least one radially projecting strip including a body portion and a projecting portion extending laterally from the body portion at a location displaced from the upper surface of the disk for a major portion of the at least one radially projecting strip. In a preferred embodiment, the body portion includes a first side and a second side, and the projecting portion extends laterally from both the first and second sides of the body portion.

In accordance with one embodiment of the feeding element of the present invention, the feeding element includes at least two of the radially projecting strips. In accordance with another embodiment of the feeding element of the present invention, the height of the at least one radially projecting strip decreases in the radially outward direction.

In accordance with another embodiment of the feeding element of the present invention, the projecting portion extends laterally substantially to the outer edge of the radially projecting strip.

The feeding device according to the present invention solves the aforesaid problems in that it brings about effective feeding of the material, while simultaneously accelerating it through the feed zone, while at the same time allowing the refining means to reverse while maintaining its effectiveness. The effective feed also contributes to a reduction of the energy consumption of the refiner.

The feeding device according to the present invention comprises a disk with at least one radial strip, which along the greater portion of its upper edge is provided with a roof, which projects outward symmetrically on both sides of the strip. The feeding device is intended to be placed on the rotary refining means directly in front of the opening for the material supply in the stationary refining means.

Based upon the design of the present feeding device, the material which is supplied is accelerated outwardly by the strip or strips, while at the same time it is locked under the roofs of the strips. The width and length of the roof along the strips must be adapted so that it will not be too great, in which case it will prevent feeding of the material through the stationary refining means. The roof, however, must be sufficiently wide to ensure transport of the material outwardly through the feed zone to the refining zone.

BRIEF DESCRIPTION OF THE DRAWINGS

The present invention is described in greater detail in the following detailed description, which in turn refers to the accompanying drawings, in which.

DETAILED DESCRIPTION

Figure 1:
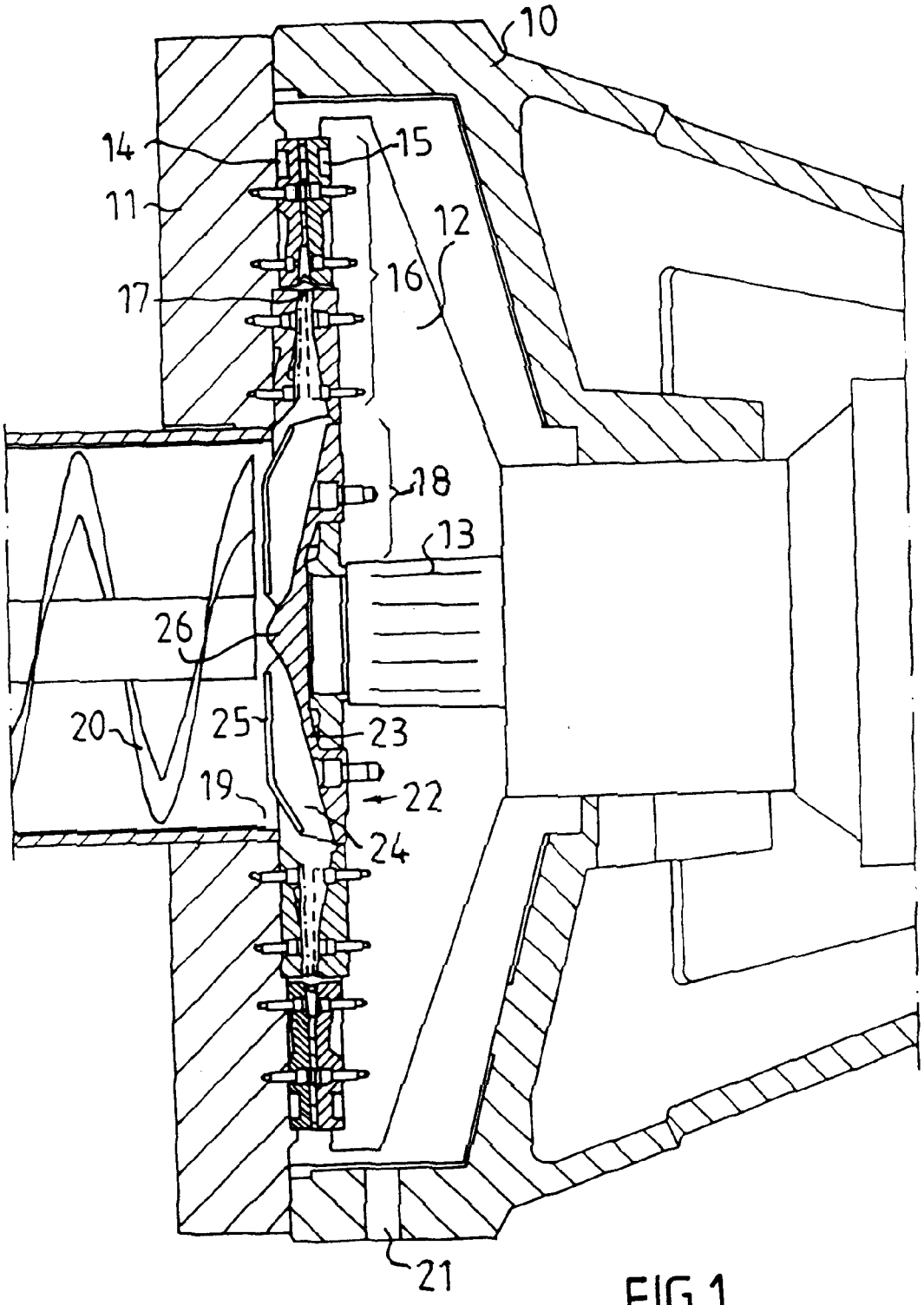
FIG. 1 is a side, elevational, cross-sectional view of a refiner with a feeding device according to the present invention.

The refiner shown in FIG. 1 comprises a refiner housing 10, in which a stationary refining means 11 (in this case the end wall of the refiner) and an opposed rotary refining means 12, attached to a rotary shaft 13, are arranged. The refining means, 11 and 12, are provided with refining elements, 14 and 15, respectively, which between them form a refining zone 16 in a refining gap 17. The refining gap 17 comprises an inside located feed zone 18. The stationary refining means 11 is formed with a central feed opening 19 for the material to be worked. A screw feeder 20 for this material is connected to the feed opening 19. The refiner housing 10 is provided with an outlet 21 for the material passing through the refining gap where it is worked to form a pulp.

A central feeding device 22 is located on the rotary refining means, which comprises a circular disk 23 with strips 24, which extend from a position close to the center radially outward towards the circumference of the disk. The number of strips should be at least one, suitably at least 2, and preferably from abut 2 to 3. The strips along the greater portion of their upper edges are provided with a roof 25, which projects outward symmetrically on both sides of the strips.

Figure 2:
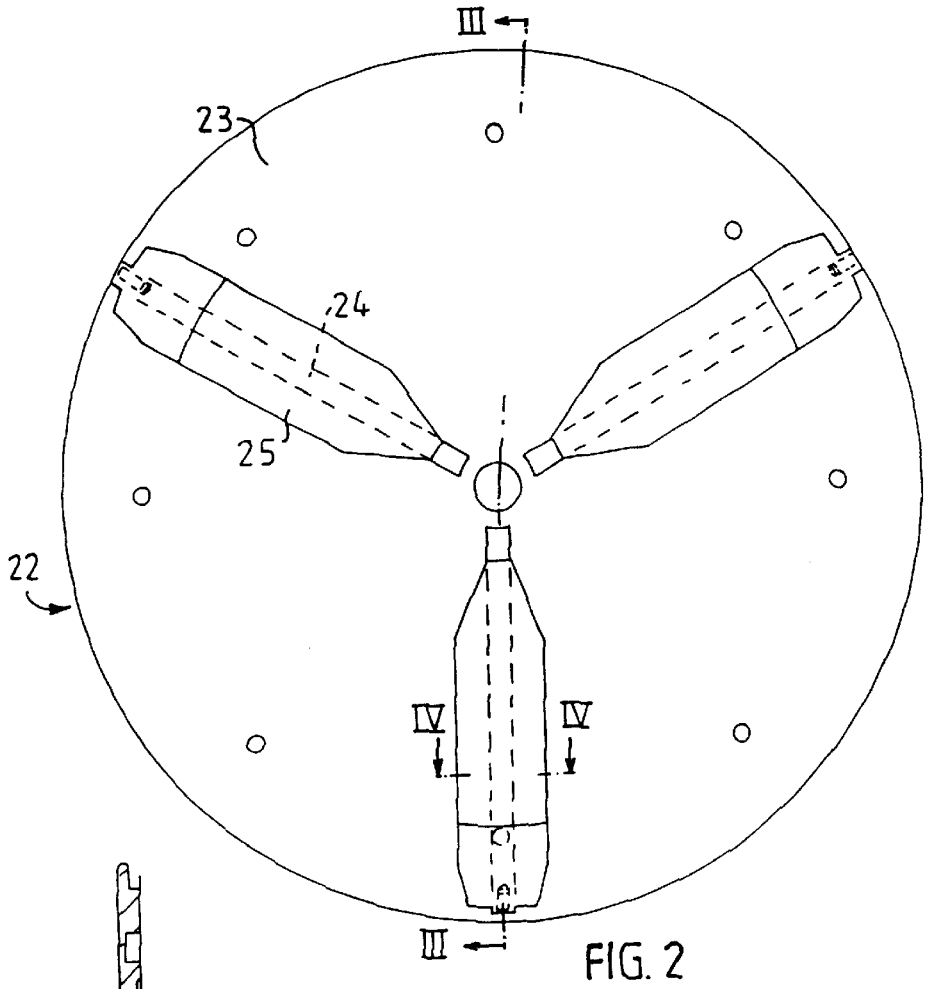
FIG. 2 is a front, elevational view of a feeding device in accordance with the present invention.
Figure 3:
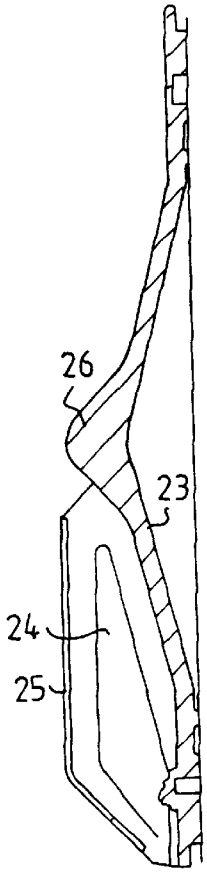
FIG. 3 is a side, elevational, partial, cross-sectional view, taken along III—III in FIG. 2.
Figure 4:
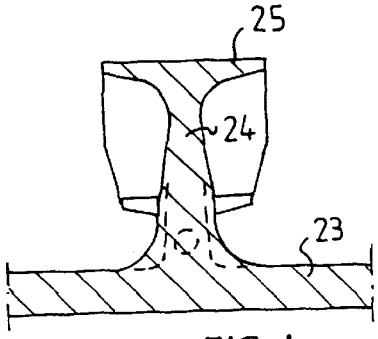
FIG. 4 is a side, elevational, partial, cross-sectional view, taken along IV—IV in FIG. 2.

According to the embodiment shown in FIGS. 2–4, the disk 23 is formed with a hub 26, from which three radial strips 24 extend. The roof 25 leaves an opening at the hub, and follows the strips 24 outwardly, preferably substantially out to the outer end of the strips. It is also possible that the roof 25 and strips 24 extend all the way to the center of the disk 23. The height of the strips decreases outwardly in order to adapt to the outside located and outwardly tapering refining zone 16.

According to FIG. 1, the disk 23 has a diameter which corresponds to the diameter of the feed opening 19. Alternatively, the disk 23 and strips 24 can extend farther out in the refining gap 17. The refiner shown in the Figures has planar refining means, but it is also possible to provide the outer portion of the refining gap with a conical shape.

The feeding device 22 is designed symmetrically in order to render possible feed in both directions of rotation.

The material fed by the screw feeder 20 into the refiner is caught by the strips 24 of the feeding device, locked under the roof 25 and accelerated outwardly along the strips. Disturbances from rearward flowing steam are at the same time minimized.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. (Amended) A feeding device for use in connection with a refiner for lignocellulosic fibrous material including a stationary refining member, a rotary refining member mounted for rotation in juxtaposition with said stationary refining member thereby forming a refining gap therebetween, a feeder for feeding said lignocellulosic fibrous material centrally to a central feed zone within said refining gap, and a refining zone extending radially outward from said central feed zone, said feeding device comprising a disk having a central portion, an outer circumference, an upper surface and a lower surface for mounting on said rotary refining member at a central location in said central feed zone, said disk including at least one radially projecting strip extending from said central portion of said disk towards said outer circumference of said disk, said at least one radially projecting sitip including a body portion and a projecting portion extending laterally from said body portion at a location displaced from said upper surface of said disk for a major portion of said at least one radially projecting strip.

2. The feeding device of claim 1 wherein said body portion includes a first side and a second side, and said projecting portion extends laterally from both said first and second sides of said body portion.

3. The feeding device of claim 1 including at least two of said radially projecting strips.

4. The feeding device of claim 1 wherein the height of said at least one radially projecting strip decreases in the radially outward direction.

5. The feeding device of claim 1 wherein said projecting portion extends laterally substantially to the outer edge of said radially projecting strip.

* * * * *

UNITED STATES PATENT AND TRADEMARK OFFICE

CERTIFICATE OF CORRECTION

PATENT NO. : 6,299,084 B1
DATED : October 9, 2001
INVENTOR(S) : Nils Virving

It is certified that error appears in the above-identified patent and that said Letters Patent is hereby corrected as shown below:

Column 1,
Line 25, before "the inner portion", insert -- in --.
Line 25, after "zone", insert -- , --.

Column 2,
Line 3, "In accordance" should start a new paragraph.

Column 3,
Line 3, "abut" should read -- about --.

Column 4,
Line 2, "(Amended)" should be deleted.
Line 17, "sitip" should read -- strip --.

Signed and Sealed this

Twenty-sixth Day of March, 2002

*Attest:*

*Attesting Officer*

JAMES E. ROGAN
*Director of the United States Patent and Trademark Office*